United States Patent [19]

Matěju et al.

[11] 3,933,184

[45] Jan. 20, 1976

[54] METHOD OF AND WEFT INSERTER FOR ELIMINATING A CHAIN FORMATION OF WEFTS NOT TRANSFERRED INTO THE BEAT-UP POSITION IN TRAVELLING-WAVE SHEDDING LOOMS

[75] Inventors: Vladimir Matěju; Zdeněk Zábrodský; Vitezslav Vašek; Josef Bleha, all of Usti nad Orlici, Czechoslovakia

[73] Assignee: Vyzkumny ustav bavlnarsky, Usti nad Orlici, Czechoslovakia

[22] Filed: Oct. 22, 1974

[21] Appl. No.: 516,907

[30] Foreign Application Priority Data

Oct. 24, 1973 Czechoslovakia ..... 7324-73

[52] U.S. Cl. ..... 139/12; 139/196.3

[51] Int. Cl.[2] ..... D03D 47/24; D03J 5/06

[58] Field of Search ..... 139/11, 12, 13, 190, 371, 139/196.3

[56] References Cited

UNITED STATES PATENTS

| | | | |
|---|---|---|---|
| 2,601,358 | 6/1952 | Ancet | 139/13 |
| 2,792,027 | 5/1957 | Thibaut et al. | 139/371 |
| 3,766,950 | 10/1973 | Vasek et al. | 139/12 |

*Primary Examiner*—Henry S. Jaudon

[57] ABSTRACT

Method of and apparatus for eliminating a chain formation of wefts not transferred into the beat-up position in a travelling-wave shedding loom provided with a rotary reed consisting of discs having cutouts for engaging weft and displacing it to the fabric fell into the beat-up position. In said method the weft laid upstream of a foreign body interwoven in the weft transferring zone of the shed angle is severed.

The weft inserter for carrying out such method comprises a rotationally supported bobbin having a weft length sufficient for a single pick, a spreading spring for spreading warp threads, directing means provided between the warp spreading spring and a weft guide, means for blocking the bobbin rotation formed with a ratchet wheel and a pawl controllable by deflecting the warp spreading spring, there being associated means for maintaining the pawl in engagement with the ratchet wheel, after return of the warp spreading spring into its starting position, until the loom stops.

5 Claims, 11 Drawing Figures

METHOD OF AND WEFT INSERTER FOR ELIMINATING A CHAIN FORMATION OF WEFTS NOT TRANSFERRED INTO THE BEAT-UP POSITION IN TRAVELLING-WAVE SHEDDING LOOMS

The present invention relates to a method of and a weft inserter for eliminating a chain formation of wefts not transferred into a beat-up position in a weaving loom with travelling-wave shed produced by heddles controlled either individually or in sections. Such a weaving loom is equipped with a fixed reed designed to guide warp threads, and with a rotary reed consisting of discs engaging into warp thread spacings and having cutouts for engaging weft and displacing it to the fabric fell, said cutouts in said face-to-face arranged discs being offset with respect to each other so as to form in common a helical groove. Each weft inserter is conveyed through the shed in a shed wave opening progressively in front of it and closing behind it, in synchronization with the rotary reed rotation.

During the weaving process it may sometimes happen that a foreign body such as, for example, a short weft remainder left in the shed by the weft inserter, dust clump, or a piece of broken warp thread, etc., penetrates into the shed angle. Upon a shed exchange, the aforesaid foreign body will be interwoven by the warp in the so-called transferring zone of the shed angle, i.e., in the space where the weft is introduced into the cutouts of discs of the rotary reed. In this way, an obstacle arises to the transferring of the weft into the beat-up position, since the weft inserter passes the foreign body and lays the weft into a false position upstream of said body so that the weft fails to be engaged by the disc cutouts of the rotary reed. During the next shed exchange the aforementioned weft is interwoven within said transferring zone of the shed angle and produces an obstacle for the next weft, etc. This failure, that is, the weft not being transferred into the beat-up position, will then be repeated with all the weft inserters following after one another in this critical place of interlacing a foreign body, until an appropriate stop motion switches off the loom. Thus in the transferring zone of the shed angle there is formed a defective fabric zone which is composed of woven-in but untransferred wefts. These wefts have to be unwoven and moreover some accompanying faults, such as warp overruns into adjacent rotary reed spacings, wrap thread breakages, etc., also should be corrected. It is evident that the unwoven wefts are missing in the fabric so that there arises an irreparable weaving fault.

It is an object of the invention to avoid the aforedescribed chain formation of untransferred wefts woven-in in the transferring zone of the shed angle.

In the method according to the invention the weft laid upstream of a foreign body interwoven in weft transferring zone of the shed angle is severed.

By severing the weft thread the corresponding disc cutouts will be disengaged, whereby the obstacle for the next weft is removed so that the latter can be easily introduced into the disc cutouts corresponding to the inserter from which said weft is unwound.

The weft inserter for carrying the afore-described method comprises a rotationally supported bobbin having a weft length sufficient for a single pick, a spreading spring for spreading warp threads, directing means provided between the warp spreading spring and a weft guide, means for blocking the bobbin rotation formed with a ratchet wheel and a pawl controllable by deflecting the warp spreading spring; according to the invention, to the pawl and the warp spreading spring there are associated means for maintaining the pawl in engagement with the ratchet wheel until the loom stops, even after return of the warp spreading spring into its starting position.

The weft inserter comprises a plate affixed to the warp spreading spring and received in a pocket-like recess in the inserter body, a reciprocatory control peg being resiliently forced to said plate. In a preferred embodiment a recess is provided in the top part of the inserter wherein there is received a semi-cylindrical body, the lower cylindrical surface of which interferes with the path of the control peg and to the top planar surface of which there is attached a flat spring which constitutes the pawl for the ratchet wheel of the bobbin and being secured by one of its ends in the inserter body while its other free end is in an operative position wherein the semi-cylindrical body is lifted by the control peg shifted therebeneath. A portion of said flat spring on the semi-cylindrical body is forced against an upper guideway for guiding the inserters and being in engagement with the ratchet wheel, so that the control peg and the semi-cylindrical body forced toward said control peg by said upper guideway constitute the means for maintaining the pawl of the flat spring in engagement with the ratchet wheel.

According to another preferred embodiment of the inserter, the pawl is formed by a flap pivotally supported in a recess provided in the top part of the inserter and adapted to be pushed from under by a blocking spring, and flap being provided with an opening into which, in the lower or inoperative position of the flap, a curved extremity of a control peg engages, while on shifting said control peg by the deflected warp spreading spring the opening of said flap is disengaged, the flap is in engagement with the ratchet wheel of the bobbin and is forced by said blocking spring toward the upper guideway for guiding the inserters so that the blocking spring and the flap constitute the means for maintaining the pawl or flap in engagement with the ratchet wheel.

The use of the afore-described means for maintaining the pawl in engagement with the ratchet wheel of the bobbin even after the return of the warp spreading spring into its starting position is necessary for the reason that the length of a foreign body can be so small that the weft thread in the inserter does not break due to an instantaneous deflection of the spreading spring by said foreign body.

In order that the invention may be better understood and reduced to practice, some preferred embodiments thereof will be hereinafter described with reference to the accompanying schematic drawings which, however, are not intended to limit in any way the scope of the invention.

Figure 8:
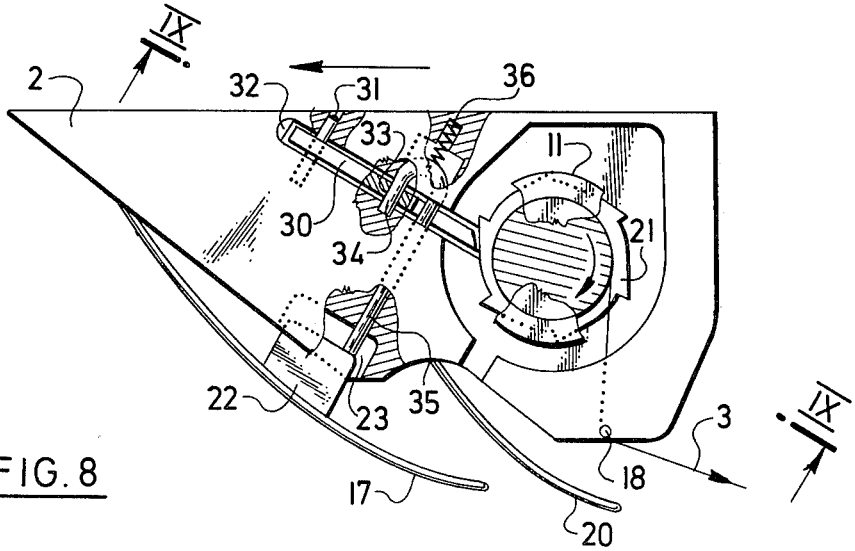
FIG. 8 is a top view of a second embodiment of the weft inserter, the pawl being in its inoperative position.
Figure 9:
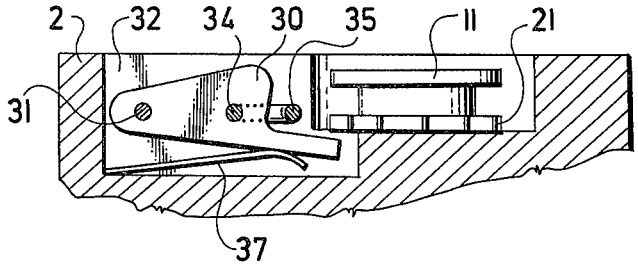
Figure 10:
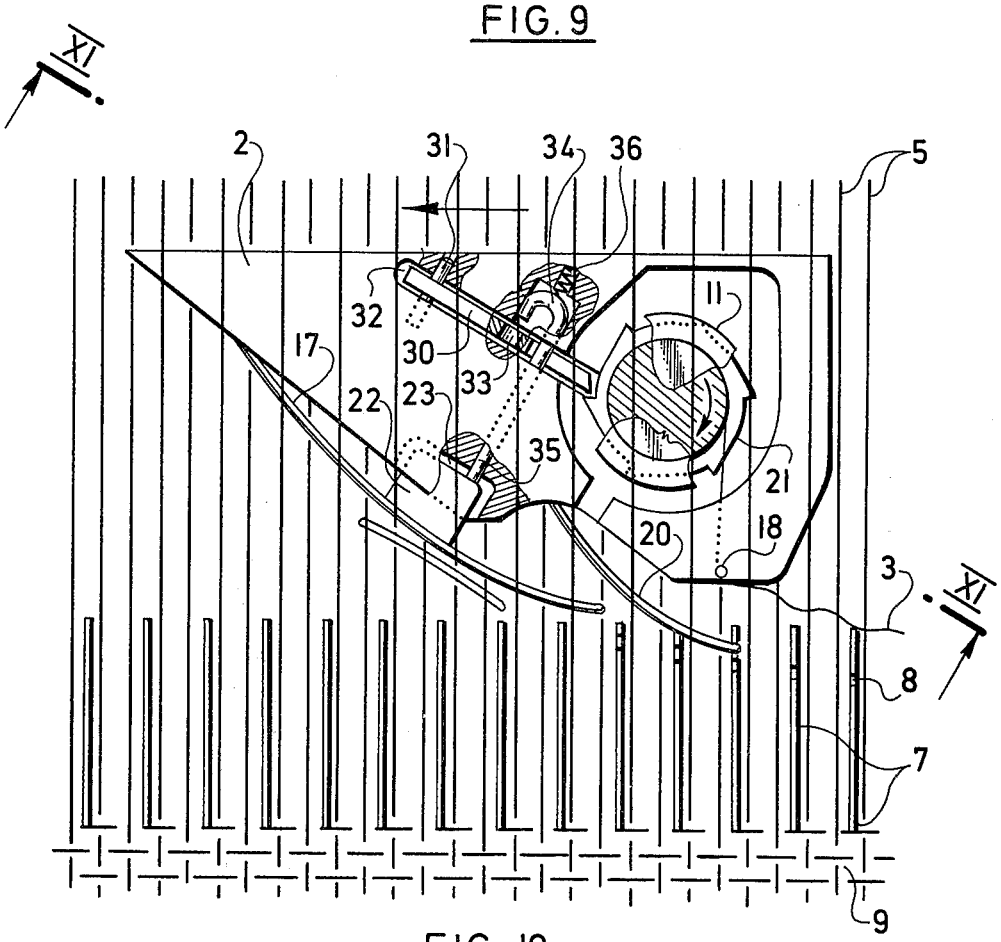
Figure 11:
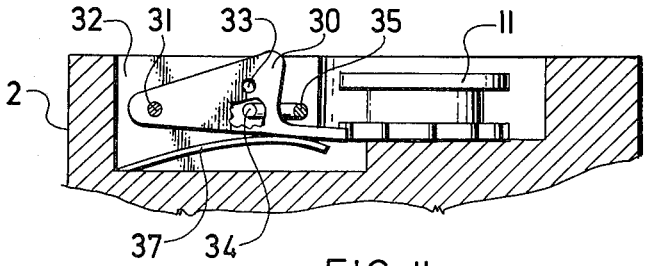

FIG. 9 is a sectional detailed view taken along the line IX—IX in FIG. 8, the pawl being shown in its inoperative position; FIG. 10 is a top view of the inserter with the pawl in its operative position, the fabric, warp yarns and rotary reed discs being additionally illustrated; and FIG. 11 is a sectional detailed view taken along the line XI—XI in FIG. 10, the warp yarns being omitted for clarity of illustration.

As is heretofore known, in travelling-wave shedding looms there are formed successive weaving sheds 1 by heddles (not shown) which heddles are controlled either individually or in groups so that in the zone passed through an inserter 2 of weft yarn 3 the shed angle is always open whereupon after the inserter passage the shed 1 becomes closed and exchanged to be ready for the next weft yarn inserter 2. The travelling-wave shedding loom is equipped, as a rule, with a fixed reed 4 (FIGS. 1, 2 and 5) for guiding warp yarns 5 and a rotary reed 6 (FIGS. 1, 2, 5 and 10) consisting of discs 7 operating between adjacent warp yarns 5, respectively. The discs 7 of the rotary reed 6 are provided with cutouts 8 for engaging the weft yarn 3 and displacing it to the fell of fabric 9. As is apparent from FIGS. 1 and 2, the cutouts 8 of the adjacent discs 7 within the whole rotary reed 6 are offset relative to each other so as to form together a helical groove 10. Thus in operation, the weft inserters 2 are conveyed through the weaving zone of the loom so as to advance in the shed wave opening before them and closing after them, in synchronization with the rotation of the rotary reed 6.

The weft inserter 2 is formed as an elongated, frontally pointed body. In a recess provided therein, a bobbin 11 is mounted for rotation which bobbin 11 is designed to receive, from a spooling device (not shown), a reserve length of weft yarn 3 sufficient for a single pick. It is to be understood that during the movement of the weft inserter 2 through the weaving shed 1, the weft yarn 3 is being unwound from the bobbin 11.

Further, the weft inserter 2 is provided with guide surfaces to mate with corresponding surfaces of the fixed reed 4 (FIGS. 1, 2 5 and 7) and of an upper guideway 12 (FIGS. 4 and 6) which guideway is disposed just above the upper shed sheet. The weft inserter 2 is adapted to be guided on said reed 4 and said guideway 12. The means for driving the weft inserter 2 in the weaving shed 1 comprise a roll 13 arranged on its lower side (FIG. 4) designed to cooperate with a drive roller 14 secured to a drive chain 15 which drive chain is arranged in a lower guideway 16 below the lower shed sheet.

During its passage through the shed 1, the weft inserter 2 has periodically to clear the shed angle, which means to make its way through the shed 1. This operation is necessary, for instance, in case of the so-called cottered ends. To this purpose the weft inserter 2 is equipped by a spreading spring 17 (FIGS. 1, 2, 3, 5, 7, 8 and 10).

Further, the weft inserter 2 is provided with a weft guide 18 (FIGS. 3, 8 and 10), for guiding the weft yarn 3 being unwound from the bobbin 11 and inserted into the weaving shed 1. The weft guide 18 can be formed, for example, as a peg.

Figure 1:
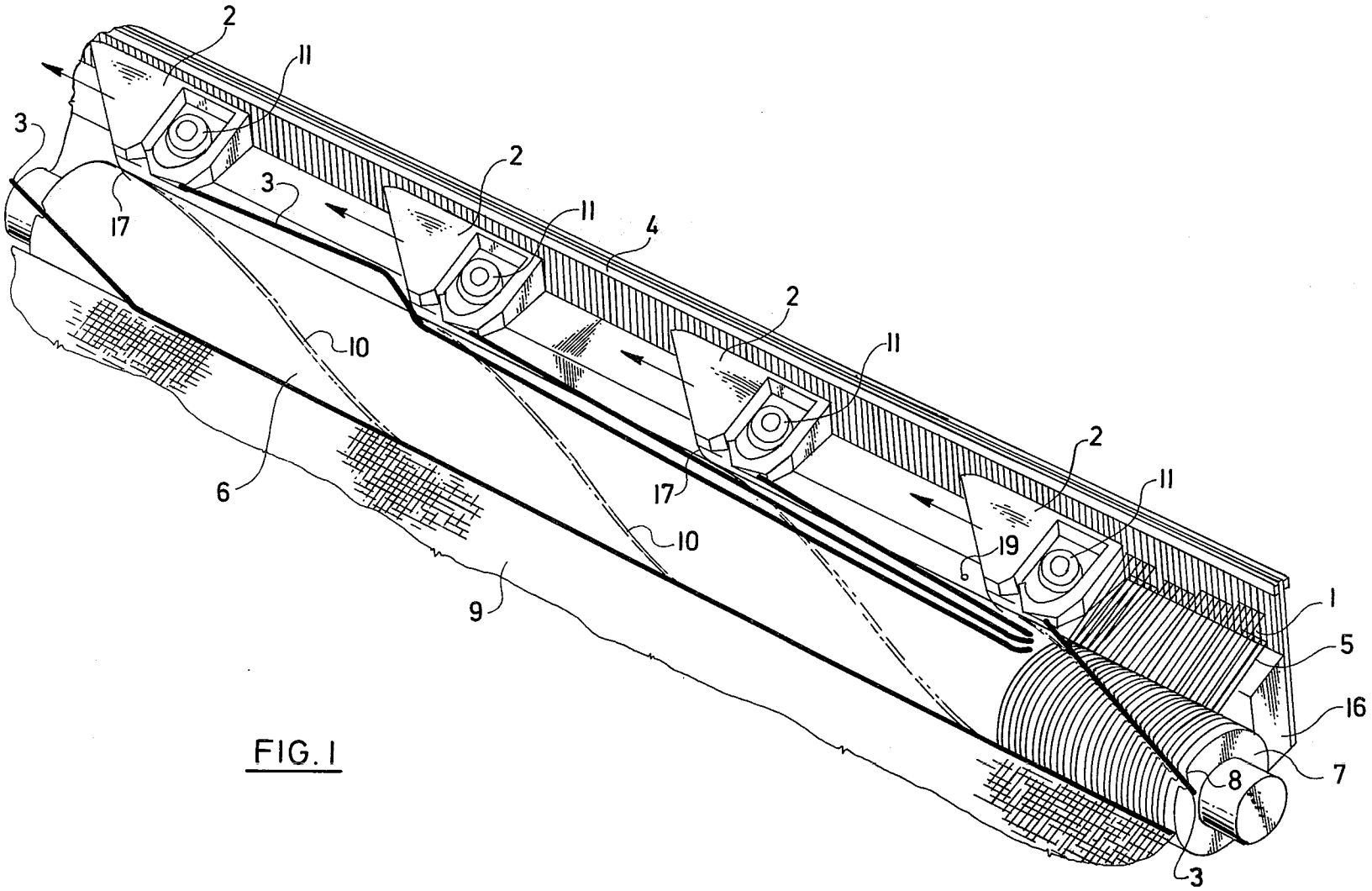
FIG. 1 is a perspective detail view of a travelling-wave shedding loom, wherein there is illustrated the formation of wefts untransferred into the beat-up position, the weft yarns being omitted for the sake of clarity.

FIG. 1 shows the existing state of operation prevailing on a wave-travelling shedding loom after a foreign body 19 has entered the shed angle. The foreign body 19 is interwoven by warp 5 in the so-called transferring zone of the shed angle, i.e., in the space in which the weft 3 should be introduced into the cutouts 8 of the rotary reed 6 designed to transfer it to the fabric 9. In view of the presence of the interwoven foreign body 19, however, the shed 1 becomes shortened and the inserter 2 passing through said shortened shed 1 will lay the weft 3 into a false position upstream of said body 19 so that the weft 3 cannot be introduced into the corresponding cutouts 8 of the discs 7 of the rotary reed 6 and is thereupon immediately interwoven by warp yarns 5 also in the afore-mentioned transferring zone of the shed angle. Thus, the untransferred weft 3 prevents the next weft 3 from being introduced into said cutouts 8, which next weft 3 will in turn lay an obstacle for the next following weft 3, etc., which results in a chain formation of wefts 3 not transferred into the beat-up position.

Two exemplary embodiments of the weft inserter according to the invention are designed to prevent this situation and are illustrated in FIGS. 3 – 11, inclusive.

Figure 3:
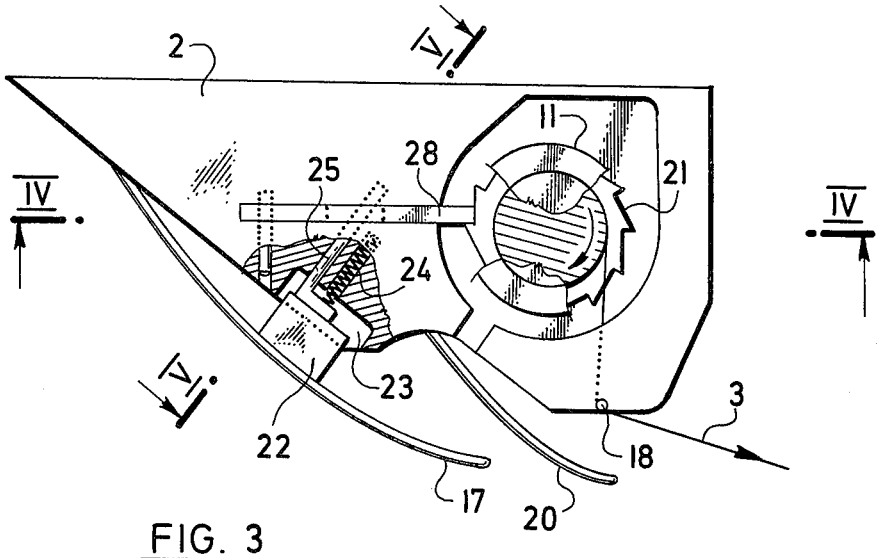
FIG. 3 is a top view of a first preferred embodiment of the improved weft inserter.

As is apparent from FIG. 3, the weft inserter 2 is provided, between the guide 18 of the weft 3 and the spreading spring 17, with a directing means such as a spring tail 20. The bobbin 11 is equipped with a ratchet wheel 21. To the spreading spring 17 a plate 22 is attached which plate is received in a pocket-like recess 23 provided in the body of the inserter 2. By means of a spring 24 a control peg 25 is forced against said plate 22 (see also FIGS. 4 and 6). In a recess 26 provided in the top part of the inserter 2, there is supported on a pin 27 a flat spring 28 received in the body of the inserter 2. To the spring 28 a semi-cylindrical body 29 is secured, the lower cylindrical surface of which interferes with the path of the control peg 25.

Figure 4:
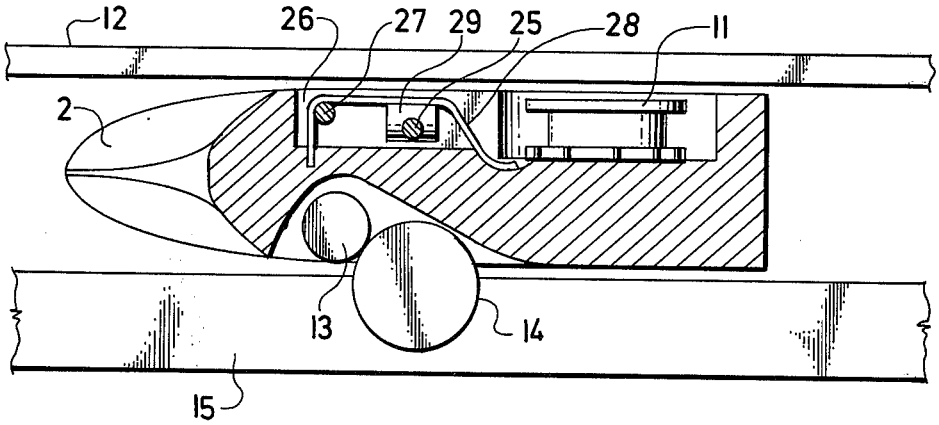
FIG. 4 is a sectional view taken along the line IV—IV in FIG. 3, wherein the upper guideway for the inserters and means for driving the inserter in the weaving shed are additionally illustrated, the pawl being shown in its inoperative position.
Figure 5:
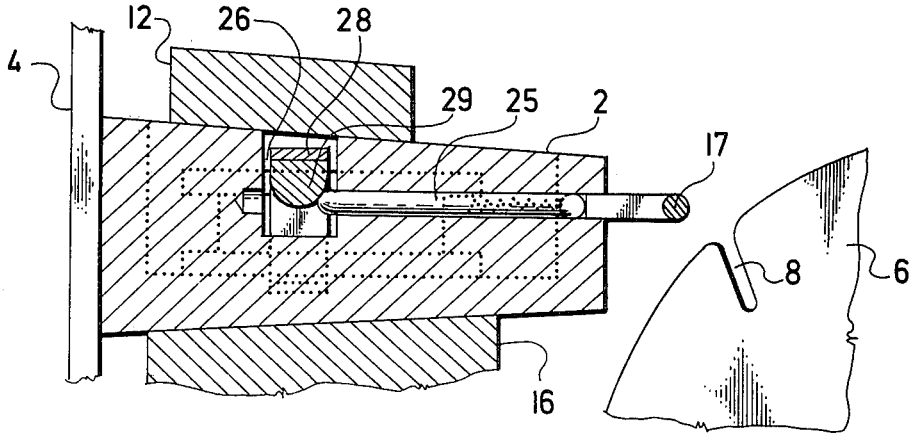
FIG. 5 is a sectional view taken along the line V—V in FIG. 3, wherein the rotary reed, the disc thereof and both the upper and lower guideways for the inserters are additionally illustrated, the pawl being shown in its inoperative position.
Figure 6:
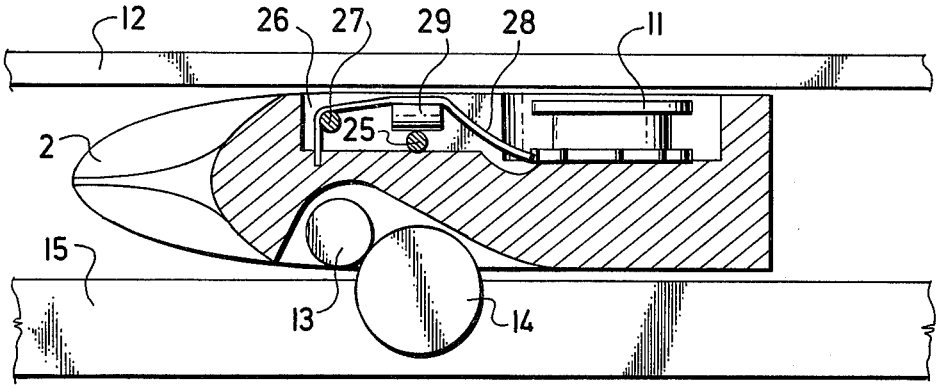
FIG. 6 is the same sectional view as shown in FIG. 4, the pawl being in its operative position.
Figure 7:
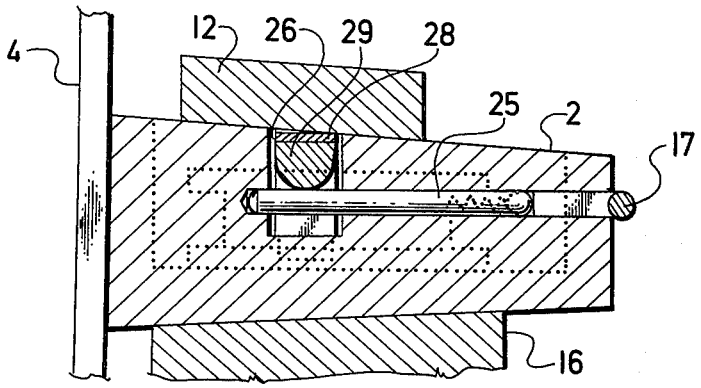
FIG. 7 is the same sectional view as shown in FIG. 5, the pawl being in its operative position.

In FIGS. 3, 4 and 5, respectively, the flat spring 28 forming a pawl for the ratchet wheel 21, is shown in its inoperative position. After the spreading spring 17 has been compressed by the interwoven foreign body 19, the plate 22 will displace the control peg 25 against the load of the spring 24, which peg lifts the semi-cylindrical body 29. Since said semi-cylindrical body 29 bears at present, via the flat spring 28, upon the upper guideway 12 for the inserters 2, the control peg 25 is blocked due to a back pressure of said upper guideway 12 against the semi-cylindrical body 29, in its operative position shown in FIGS. 6 and 7. The control peg 25 remains blocked even after the spreading spring 17 has returned to its starting position.

By lifting the semi-cylindrical body 29, the flat spring 28 will be deflected and its free end gets into engagement with the ratchet wheel 21 so that it blocks the rotation of the bobbin 11. The weft yarn 3 being tensioned between the fabric 9 and the inserter 2 with the blocked bobbin 11, proceeds its movement until it breaks, due to the excessive tension. Simultaneously the foreign body 19 will be displaced by the spring tail 20 to the periphery of the rotary reed 6 which engages it by the corresponding cutout 8 and transfers it to the fabric 9 whereby the obstacle for the weft 3 from the next inserter 2 is removed.

As soon as the loom is switched off by a suitable stop motion, the inserter 2 is no longer forced against the upper guideway 12 so that the control peg 25 is disengaged, by means of the spring 24, from under the semi-cylindrical body 29. Thereby the flat spring 28 is returned into the starting or inoperative position in which the pawl in the form of the flat spring 28 is out of the engagement with the ratchet wheel 21 of the bobbin 11.

After the loom has stopped and the bobbin 11 has been unblocked, the operator introduces the broken weft 3 into the corresponding cutouts 8 of the discs 7 of the rotary reed 6.

Figure 2:
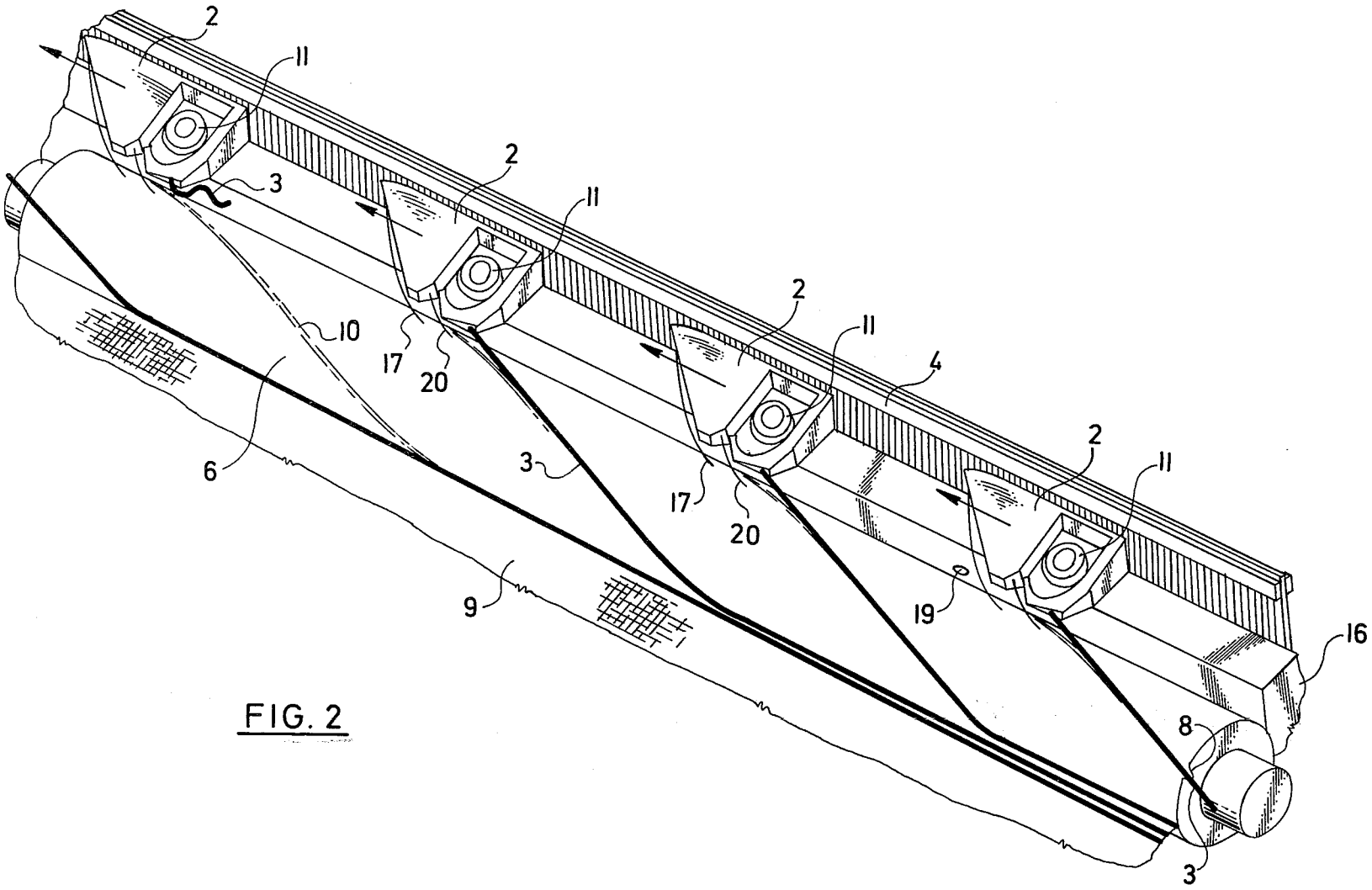
FIG. 2 is a view similar to FIG. 1 illustrating the use of the weft inserters according to the invention to eliminate the formation of untransferred wefts.

The situation prevailing in the weaving loom when applying the weft inserter 2 according to the invention, is apparent from FIG. 2. The weft 3 from the first inserter 2 detecting the presence of a foreign body 19, breaks, whereupon the next wefts 3, before the loom stops, are introduced into the corresponding cutouts 8 of the rotary reed 6, said reed transferring them to the beat-up position.

The embodiment of the weft inserter as shown in FIGS. 8 – 11, inclusive, differs from the afore-described inserter in that the pawl is constituted by a flap 30 arranged to swing on a pivot 31 fixed in a recess 32 provided in the top part of the inserter 2 in FIGS. 8 – 11, inclusive. The flap 30 is provided with an opening 33 receiving, in the inoperative position of the flap 30, a curved extremity 34 of a control peg 35 which control peg is forced by a spring 36 to the plate 22 affixed to the spreading spring 17. The flap 30 is forced to its upper position by a blocking spring 37.

After the spreading spring 17 has been compressed by an interwoven foreign body 19, the curved extremity 34 of the control peg 35 is disengaged, overcoming the load of the spring 36, from the opening 33 of the flap 30 whereupon the latter will be forced by the blocking spring 37 against the straight portion of the control peg 35. In this lift position illustrated in FIG. 11, in which the flap 30 is engaged by the teeth of the ratchet wheel 21 and blocks thereby the rotation of the bobbin 11, the flap 30 remains until the loom is switched off by an appropriate stop motion, in spite of the fact that the spreading spring 17, after an instantaneous deflection, returns into its starting position. Although the control peg 35 is forced toward the plate 22, the curved extremity 34 thereof is forced against the solid wall of flap 30 so that it cannot enter the opening 33 that has been displaced.

Analogously as with the weft inserter described with reference to FIGS. 3 – 7, inclusive the weft 3 breaks between the fabric 9 and the blocked bobbin 11 as the inserter of FIGS. 8 – 11, inclusive, proceeds in its movement while the spring tail 20 brings the displaceable foreign body 19 to the periphery of the cutouts 8 of the rotary reed 6 so that said body 19 will be transferred by a free cutout 8 to the fell of the fabric 9.

After the loom has been switched off by an appropriate stop motion, the flap 30 is compressed so that the control peg 35 is introduced by its curved extremity 34 into the opening 33 of the flap 30. Thereby the bobbin 11 gets unblocked and the operator can insert the broken weft 3 into the corresponding cutouts 8 of the discs 7 of the rotary reed 6.

Although the invention is illustrated and described with reference to a plurality of preferred embodiments thereof, it is to be expressly understood that it is in no way limited to the disclosure of such a plurality of embodiments, but is capable of numerous modifications within the scope of the appended claims.

What is claimed is:

1. Method of eliminating a chain formation of wefts not transferred into its beat-up position due to the presence of a foreign body interwoven in the weaving shed in a travelling-wave shedding loom provided with a plurality of weft inserting means travelling one after the other into said weaving shed, the shed being closed behind each inserting means and after having been exchanged, being open in front of each weft inserting means, the loom being provided with a rotary reed consisting of discs having cutouts for engaging weft inserted by said weft inserting means into the weaving shed and for displacing it to the fabric fell into the beat-up position, said method comprising severing the weft laid upstream of the interwoven foreign body beyond the reach of the discs of said rotary reed.

2. A weft inserter for eliminating a chain formation of wefts not transferred into the beat-up position in a travelling-wave shedding loom provided with a rotary reed consisting of discs having cutouts for engaging weft and displacing it to the fabric fell into the beat-up position, comprising a rotationally supported bobbin having a ratchet wheel and carrying a weft length sufficient for a single pick, a spreading spring for spreading warp threads, forming the warp shed, a weft guide, directing means provided between the warp spreading spring and said weft guide, means for blocking rotation of the bobbin comprising a pawl controllable by the warp spreading spring from starting position to a blocking position, means associated with the pawl and the warp spreading spring for maintaining the pawl in engagement with the ratchet wheel, even after return of the warp spreading spring into its starting position, until the loom stops.

3. A weft inserter as claimed in claim 2, comprising a plate affixed to the warp spreading spring and received in a pocket-like recess in the inserter body and a reciprocatory peg control resiliently forced toward said plate.

4. A weft inserter as claimed in claim 3, wherein a recess is provided in the top part of the inserter, a semi-cylindrical body is received in said recess, the lower cylindrical surface of the semi-cylindrical body interfering with the path of the control peg, to the top planar surface of the semi-cylindrical body there is attached a flat spring, the flat spring constituting the pawl for the ratchet wheel of the bobbin and being secured by one of its ends in the inserter body while its other free end is in an operative position wherein the semi-cylindrical body is lifted by the shifting of the control peg therebeneath, a portion of said flat spring on the semi-cylindrical body being forced against an upper guideway for guiding the inserters and being in engagement with the ratchet wheel, the control peg and the semi-cylindrical body forced toward said control peg by said upper guideway constituting the means for maintaining the pawl or flat spring in engagement with the ratchet wheel.

5. A weft inserter as claimed in claim 3, comprising a plate affixed to the warp spreading spring, wherein the pawl is formed by a flap pivotally supported in a recess provided in the top part of the inserter and adapted to be pushed from under by a blocking spring, said flap being provided with an opening into which, in the lower or inoperative position of the flap, a curved extremity of a control peg engages, while on shifting said control peg by the deflected warp spreading spring, the opening of said flap is disengaged, the flap is in engagement with the ratchet wheel of the bobbin and is forced by said blocking spring toward the upper guideway for guiding the inserters, the blocking spring and the flap constituting the means for maintaining the pawl or flap in engagement with the ratchet wheel.

* * * * *